United States Patent [19]

Aihara et al.

[11] 4,405,241

[45] Sep. 20, 1983

[54] ELECTRONIC DEVICE HAVING TIMEPIECE FUNCTION

[75] Inventors: Toshiharu Aihara, Kodaira; Iwao Tahara, Higashiyamato; Yushin Matsuo, Chofu; Naoki Takahashi, Fussa, all of Japan; Takuo Wakabayashi, deceased, late of Saitama, Japan; Shigemasa Wakabayashi, executor, Nagano, Japan

[73] Assignee: Casio Computer Co., Ltd., Tokyo, Japan

[21] Appl. No.: 213,044

[22] Filed: Dec. 4, 1980

[30] Foreign Application Priority Data

Dec. 11, 1979 [JP] Japan ..... 54-161291

[51] Int. Cl.[3] ..... G04C 21/32; G04C 21/14

[52] U.S. Cl. ..... 368/63; 368/73; 368/109; 368/246; 368/251; 368/274; 364/710

[58] Field of Search ..... 368/63, 72, 73, 9, 243, 368/108, 244, 109, 245, 246, 250, 251, 256, 274; 364/710; 179/1 SM

[56] References Cited

U.S. PATENT DOCUMENTS

| | | | |
|---|---|---|---|
| 3,875,738 | 4/1975 | Ichikawa et al. . | |
| 3,919,834 | 11/1975 | Murakami et al. | 368/63 |
| 3,998,045 | 12/1976 | Lester | 368/63 |
| 4,162,610 | 7/1979 | Levine . | |
| 4,266,096 | 5/1981 | Inoue et al. | 368/63 X |
| 4,267,589 | 5/1981 | Yamaguchi | 368/251 X |
| 4,276,541 | 6/1981 | Inoue et al. | 368/9 X |

FOREIGN PATENT DOCUMENTS

| | | |
|---|---|---|
| 2710716 | 9/1977 | Fed. Rep. of Germany . |
| 54-143269 | 11/1979 | Japan . |
| 1554219 | 10/1979 | United Kingdom . |
| 2019051 | 10/1979 | United Kingdom . |
| 2022880 | 12/1979 | United Kingdom . |
| 2046961 | 11/1980 | United Kingdom . |

*Primary Examiner*—B. A. Reynolds
*Assistant Examiner*—Philip H. Leung
*Attorney, Agent, or Firm*—Frishauf, Holtz, Goodman & Woodward

[57] ABSTRACT

Voice sounds can be recorded by recording sections in an electronic device having a timepiece function. The voice sounds indicate the purposes corresponding to alarm times so that the recorded contents may be reproduced upon operation of a particular switch.

7 Claims, 8 Drawing Figures

ELECTRONIC DEVICE HAVING TIMEPIECE FUNCTION

BACKGROUND OF THE INVENTION

The present invention relates to an electronic device having a timepiece function which is capable of recording a human voice.

Electronic devices having a timepiece function are recently becoming multi-functional. They may include, for example, an alarm function and a timer function. The alarm function is used, for example, for informing the time by generating a single sound of a predetermined frequency or generating a predetermined musical melody. However, such an alarm sound can only be a single sound or a melody supplied by the manufacturer, so that it may not suit the taste of the customer and may soon become boring. Further, it is difficult to know immediately what the generated sound indicates, that is, for what purpose the alarm time has been set. Due to this, the customer had to memorize the purpose of the alarm in advance to be able to judge the purpose of the alarm.

The present invention has been made to overcome these problems and has for its object to provide an electronic device having a timepiece function wherein it is possible to know for what purpose an alarm has been set by recording a voice to correspond with the alarm time and by generating the recorded voice as the alarm sound at the alarm time; and wherein the customer is able to confirm in advance what kind of voice will be generated at the alarm time.

SUMMARY OF THE INVENTION

In order to accomplish the above and other objects, the present invention provides an electronic device having a timepiece function comprising: alarm time storing means for storing alarm times; means for receiving a voice sound input from outside; voice information storing means for storing voice information received by said receiving means as digitally encoded information; first sound generating means for reading out said voice information stored in said voice information storing means to generate sounds at said alarm times stored in said alarm time storing means; external operation switch for supplying readout instructions for said voice information; and second sound generating means for reading out said voice information stored in said voice information storing means for generating a voice sound in response to operation of said external operation switch means.

With the construction described above, the purpose of the alarm time may be readily understood by simply listening to the alarm sound. By operating external switches, the alarm sounds of the alarm times are sequentially generated according to the order of the alarms. Accordingly, it is possible to know what kind of voice will be generated so as to confirm the schedule of the day. Further, by generating the recorded information by operating the external switches after recording the voice alarms, it is possible to confirm whether the recording has been completed in a correct manner.

This invention can be more fully understood from the following detailed description when taken in conjunction with the accompanying drawings:

DETAILED DESCRIPTION

Figure 1A:
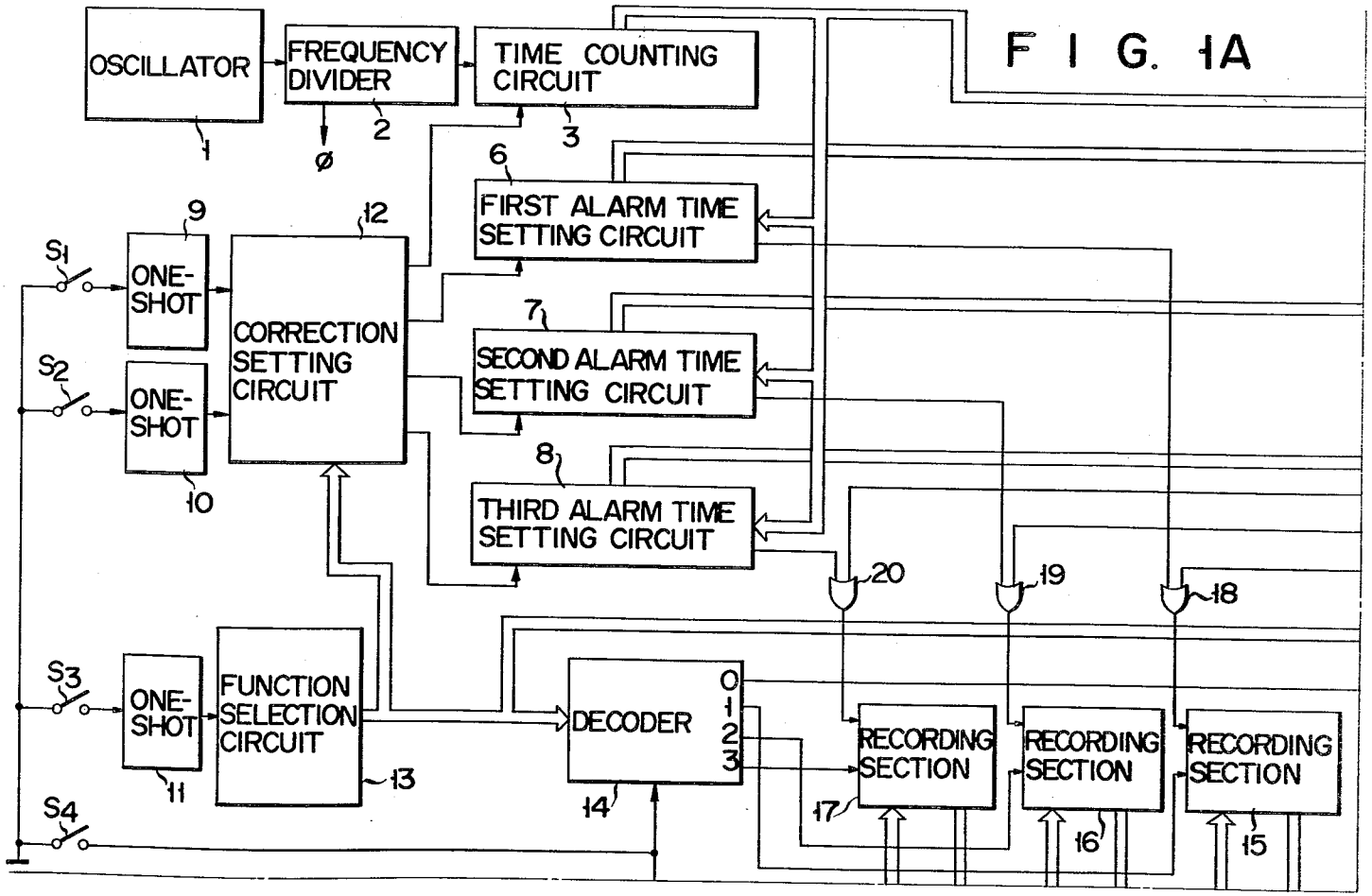
FIGS. 1A, 1B and 1C are block diagrams illustrating the circuit construction of an electronic timepiece to which the present invention is applied.
Figure 1B:
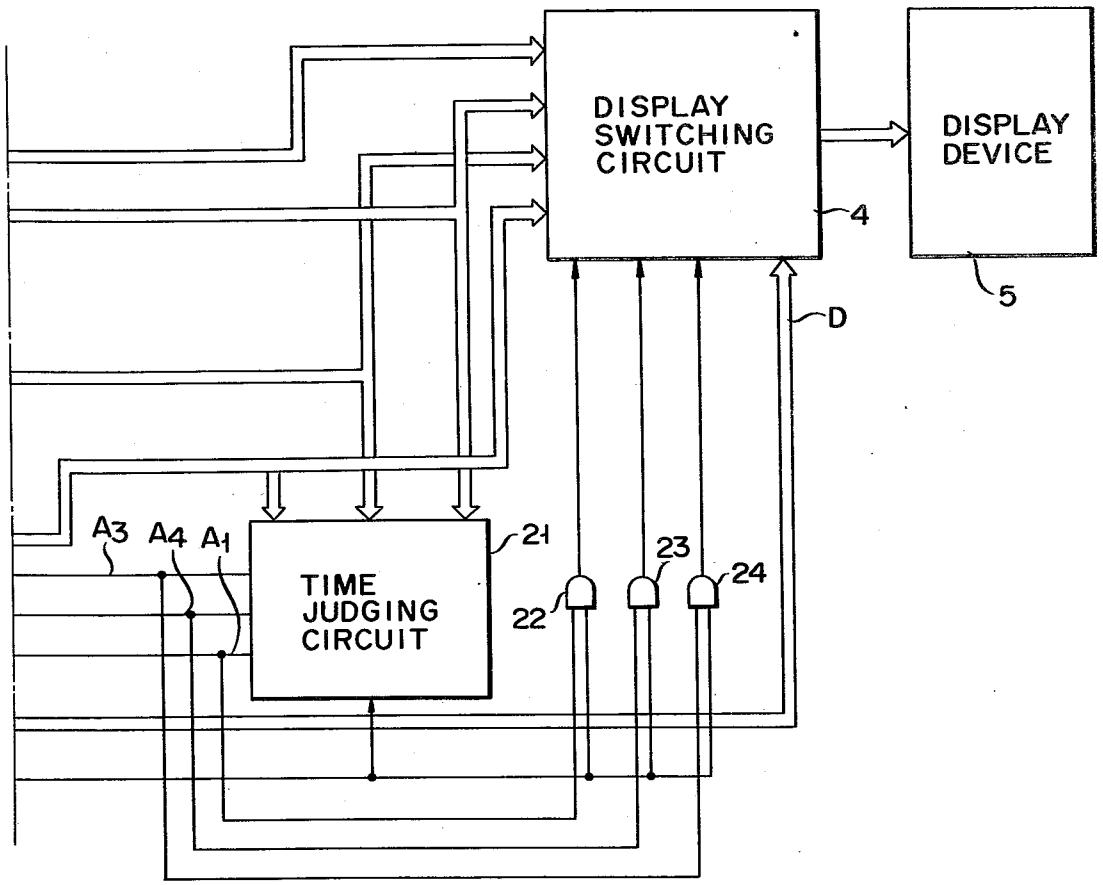
Figure 1C:
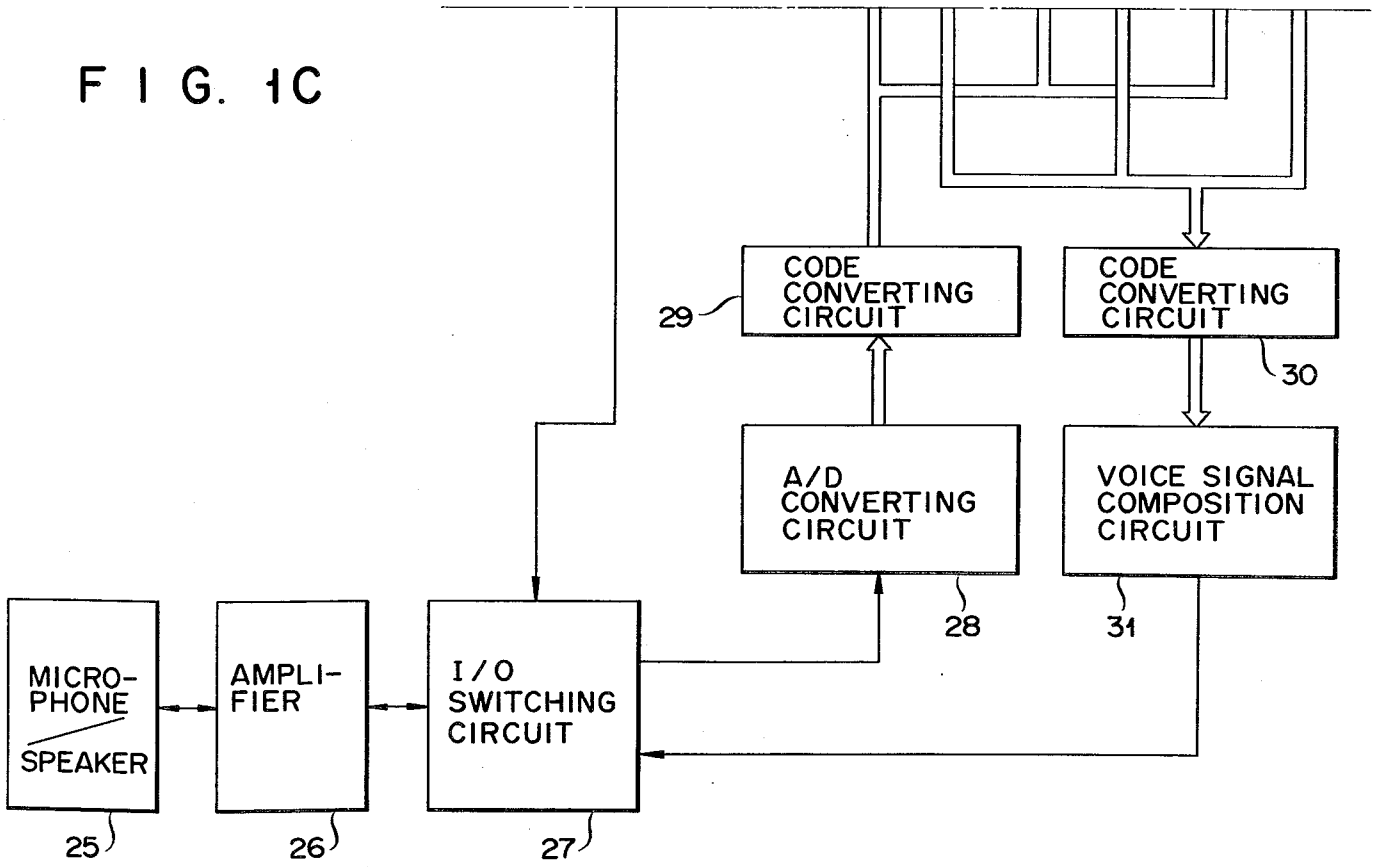
Figure 2:
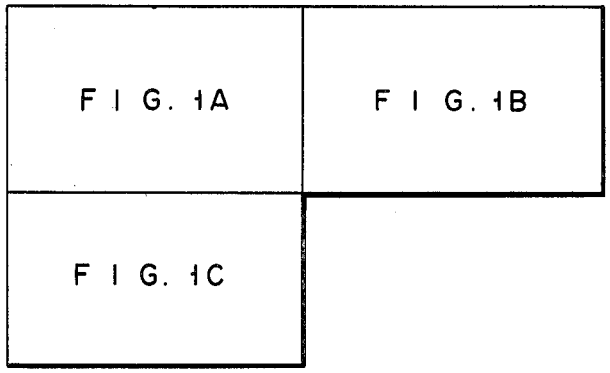
FIG. 2 is a view illustrating the relative arrangement of the block diagrams of FIGS. 1A, 1B and 1C.

The present invention will now be described with reference to one embodiment thereof, referring to the accompanying drawings. Parts shown in FIGS. 1A, 1B and 1C are arranged as shown in FIG. 2. Referring to FIG. 1A, numeral 1 denotes an oscillator for generating a reference clock pulse signal, 2 is a frequency divider for frequency dividing the reference clock pulse signal into signals of one second period, and 3 is a time counting circuit for counting time and day information based on the signals of one second period. The time information obtained by this time counting circuit 3 is displayed digitally when supplied to a display device 5 comprising liquid crystals or the like through a display switching circuit 4 as shown in FIG. 1B. The time information from the time counting circuit 3 is also supplied to first through third alarm time setting circuits 6 to 8. Different pieces of the alarm time information are stored in advance in these alarm time setting circuits 6 to 8. Respective pieces of the alarm time information are displayed digitally when supplied to the display device 5 through the display switching circuit 4. The first to third alarm time setting circuits 6 to 8 compare the alarm time information stored therein with the time count information supplied from the time counting circuit 3. When they have detected a correspondence, they each output a correspondence signal.

Symbols S1 and S2 are external operating swtiches which are used to correct the time and set the time; the switch S1 is a digit selection switch for selecting the digit to be corrected or set, and the switch S2 is an advancing switch for changing the selected digit by advancing it. Symbols S3 and S4 are also external switches; the switch S3 is a function selection switch for selecting one of the first to third alarm time setting circuits 6 to 8, and the switch S4 is a record/confirm switch for recording a voice and for confirming what kind of voice is generated at an alarm time. The operation signals of the digit selection switch S1, the advancing switch S2 and the function selection switch S3 are supplied to corresponding one-shot circuits 9 to 11. Pulse signals from the one-shot circuits 9 and 10 are supplied to a correction setting circuit 12, and pulse signals from the one-shot circuit 11 are supplied to a function selection circuit 13. This function selection circuit 13 comprises a quaternary counter. In response to the pulse signals from the one-shot circuit 11, the contents of the function selection circuit 13 are sequentially advanced along "0", "1", "2", "3", "0", . . . and the contents are supplied to the correction setting circuit 12. When the contents of the function selection circuit 13 are set to "0" by operating the switch S3, the correction setting circuit 12 selects the time counting circuit 3 and the contents of the time counting circuit 3 is corrected by the operation of the digit selection switch S1 and the advancing switch S2. When the contents of the function selection circuit 13 are set to "1", "2", and "3" by operating the switch S3, the first alarm time setting circuit 6, the second alarm time setting circuit 7, and the third alarm time setting circuit 9 are selected, and the alarm time is set for the circuit selected by the digit selection switch S1 and the advancing switch S2. The operation signal of the record/confirm switch S4 is supplied as an operation instruction signal to a decoder 14 for decoding the contents of the function selection circuit 13 as well as to an I/O switching circuit of FIG. 3C to be described later. While the operation signal of the record/confirm switch S4 is supplied, the decoder 14 decodes the contents of the function selection circuit 13 and outputs signals "0" to "3" corresponding to the contents of the function selection circuit 13.

The output contents of the function selection circuit 13 are supplied as a display switching signal D to the display switching circuit 4 shown in FIG. 1B. When the contents of the function selection circuit 13 are set to be "0", "1", "2", and "3", respectively, the display switching circuit 4 selectively outputs for selective display the time count information of the time counting circuit 3, the alarm information of the first alarm time setting circuit 6, the alarm information of the second alarm time setting circuit 7, and the alarm information of the third alarm time setting circuit 8.

The signal "1" outputted from the decoder 14 is supplied as a write instruction signal for outputting the voice sound to a recording section 15 corresponding to the first alarm time setting circuit 6. In a similar manner, the signals "2" and "3" are supplied to a recording section 16 corresponding to the second alarm time setting circuit 7 and a recording section 17 of the third alarm time setting circuit 8, respectively, as write instruction signals for outputting the voice sound. The correspondence signals from the first to third alarm time setting circuits 6 to 8 are supplied to the recording sections 15 to 17 through corresponding OR circuits 18 to 20 as write instruction signals. These recording sections 15 to 17 comprise semiconductor memories, for example, shift registers, RAMs (random access memories) and so on. They perform reading out and writing with the period of a clock pulse signal $\phi$ of a predetermined frequency outputted from the frequency divider 2. The signal "0" outputted from the decoder 14 is supplied to a time judging circuit 21 shown in FIG. 1B as an operation instruction signal, and is also supplied to three AND circuits 22 to 24 as gate control signals. The pieces of alarm time information are supplied to the time judging circuit 21 from the first to third alarm setting circuits 6 to 8. The time judging circuit 21 judges the priority of the three pieces of alarm time information, that is, the earliest time, the next earliest time, and the last time. The time judging circuit 21 operates in response to the signal "0" as the operation instruction signal from the decoder 14, and sequentially outputs signals one by one according to the order of priority of priority specifying signals A1 to A3 corresponding to the pieces of alarm time information of the first to third alarm time setting circuits 6 to 8. These priority specifying signals A1 to A3 are supplied as reading out instruction signals for the voice sound to the corresponding recording sections 15 to 17 through the OR circuits 18 to 20. Simultaneously with this, the priority specifying signal A1 is supplied as a display switching signal to the display switching circuit 4 through the AND circuit 22 to output the alarm time information of the first alarm time setting circuit 6 from the display switching circuit 4. The priority specifying signal A2 is supplied as a display switching signal to the display switching circuit 4 through the AND circuit 23, to output the alarm time information of the second alarm time setting circuit 6 from the display switching circuit 4. The priority specifying signal A3 is supplied to the display switching circuit 4 through the AND circuit 24 as a display switching signal, to output the alarm time information of the third alarm time setting circuit 8 from the display switching circuit 4.

Figure 3A:
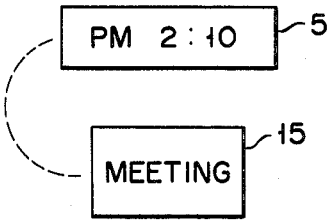
FIGS. 3A, 3B and 3C are views illustrating the relation between the displays of the alarm times at the display device and the recorded contents of the recording sections corresponding to the alarm times.
Figure 3B:
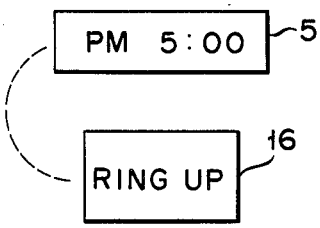
Figure 3C:
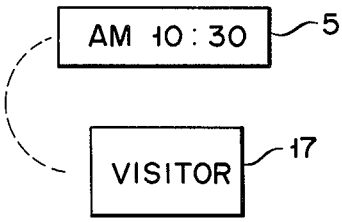

Numeral 25 shown in FIG. 3C is a microphone/speaker disposed outside the timepiece; it is connected to the I/O (Input/Output) switching circuit 27 through an amplifier 26. This I/O switching circuit 27 functions as an input circuit when recording the voice and functions as an output circuit when generating the voice sound.

The voice signals input through the microphone 25, the amplifier 26, and the I/O switching circuit 27 is supplied to an A/D (analog to digital) converting circuit 28. This A/D converting circuit 28 converts analog voice signals into digital voice signals and supplies them to a code converting circuit 29. This code converting circuit 29 converts the code of the digital voice signals into codes of pitch, volume and so on. The code-converted digital signals are supplied to the recording sections 15 to 17 to be written therein. The voice data written in the recording sections 15 to 17 are read out according to the order in which they were recorded. The voice data read out from the recording sections 15 to 17 are supplied to a voice signal composition circuit 31 through a code converting circuit 30 which performs the reverse code-converting operation from that performed by the code converting circuit 29. This voice signal composition circuit 31, based on the signal code-converted by the code converting circuit 29 and on the clock pulse signal $\phi$ of predetermined frequency outputted from the frequency divider 2, converts and composes a voice signal. The voice signal thus obtained is supplied through the I/O switching circuit 27 and the amplifier 26 to the speaker 25 to be outputted.

The mode of operation of the electronic timepiece of the above construction will be described with reference to FIGS. 3A, 3B, 3C and 4. "1" is set in the function selection circuit 13 by operating the function selection switch S3. An alarm time (e.g., 2:10 P.M.) is set in the first alarm time setting circuit 6 by operating the digit selection switch S1 and the advancing switch S2. After setting "2" in the function selection circuit 13 by operating the switch S3, the switches S1 and S2 are operated to set an alarm time (e.g., 5:00 P.M.) in the second alarm time setting circuit 7. Further, after setting "3" in the function selection circuit 13 by operating the switch S3, the switches S1 and S2 are operated to set an alarm time (e.g., 10:30 A.M.) in the third alarm time setting circuit 7. When there is a business meeting with a client at the alarm time (2:10 P.M.) set at the first alarm time setting circuit 6, the voice "meeting" is recorded in a manner corresponding to the alarm time. The switch S3 is operated to set "1" in the function selection circuit 13 so that the alarm time (2:10 P.M.) of the first alarm time setting circuit 6 is displayed at the display device 5 as shown in FIG. 3A. When the record/confirm switch S4 is operated under this condition, the decoder 14 operates while the switch S4 is being operated and outputs a signal of "1" obtained by decoding the contents of the function selection circuit 13. In response to the signal "1" outputted from the decoder 14, the recording section 15 is placed under the writing condition. "Meeting" is correctly pronounced into the microphone 25, as a reminder of a meeting to occur at 2:00 P.M. The voice signal input from the microphone 25 is amplified by the amplifier 26 and supplied to the A/D converting circuit 28 through the I/O switching circuit 27 to be converted into the digital voice signal. The signal is written in the recording section 15 as shown in FIG. 3A after encoded by the code converting circuit 29, and the voice code for the voice sound "meeting" is stored.

When one has to make a phone call at the alarm time (5:00 P.M.) set at the second alarm time setting circuit 7, the voice "ring up" is recorded in a manner to correspond with the alarm time. The switch S3 is operated to set the contents of the function selection circuit 13 to "2" so that the alarm time (5:00 P.M.) is displayed at the display device 5 as shown in FIG. 3B. Thereafter, when the switch S4 is operated, the decoder 14 outputs the signal "2" while the switch S4 is being operated. In response to the signal "2" outputted from the decoder 14, the recording section is placed under the condition that is capable of writing operation. When "ring up" is correctly pronounced into the microphone 25, as a reminder to make a call at 5:00 P.M., the voice code of the voice "ring up" is stored in the recording section 16 as shown in FIG. 3B.

When one expects a visitor at the alarm time (10:30 A.M.) set at the third alarm time setting circuit 8, the switch S3 is operated to set the contents of the function selection circuit 13 to "3" so that the alarm time (10:30 A.M.) is displayed at the display device 5 as shown in FIG. 3C. When the switch S4 is operated thereafter, the signal of "3" is outputted from the decoder 14, and the recording section 17 is placed under the condition that is capable of writing operation. When "visitor" is correctly pronounced into the microphone 25, as a reminder that a visitor is expected at 10:30 A.M., the voice code of the voice "visitor" is stored at the recording section 17 as shown in FIG. 3C.

Figure 4:
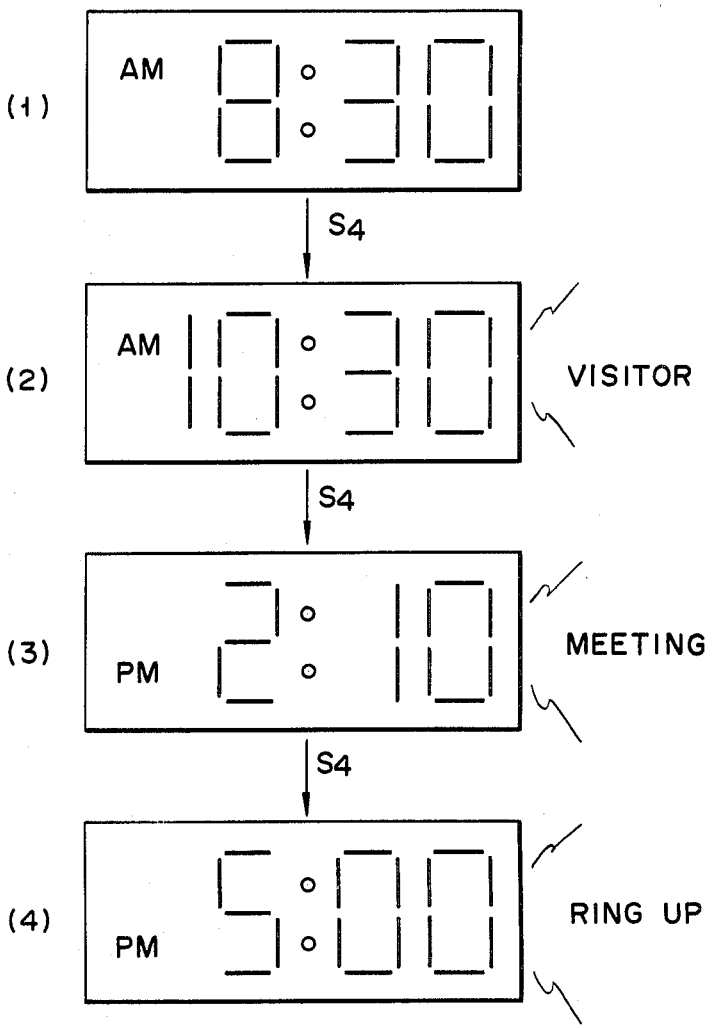
FIG. 4 is a view illustrating the display condition changing according to the switch operation and the generated condition of the recorded contents.

After the above sequence of operations, the contents of the function selection circuit 13 is "0" under the condition that the normal time, that is, AM 8:30 is displayed at the display device 5 as shown in FIG. 4(1).

When the switch S4 is operated under this condition, the decoder 14 operates while the switch S4 is being operated and the signal "0" is outputted from the decoder 14. Thus, the time judging circuit 21 is rendered operative and the gates of the AND circuits 22 to 24 are opened. As a result, the time judging circuit 21 starts operating. The time operating circuit 21 outputs the priority specifying signal corresponding to the earliest time information along the three pieces of alarm time information (2:10 P.M., 5:00 P.M., and 10:30 A.M.) input from the first to third alarm time setting circuits 6 to 8, that is, the priority specifying signal A3 corresponding to the alarm time information (10:30 A.M.) of the third alarm time setting circuit 8. Since this priority specifying signal A3 is supplied to the display switching circuit 4 through the AND circuit 24, the alarm time information of the third alarm time setting circuit 8 is outputted from the display switching circuit 4, and "AM 10:30" is displayed at the display device 5 as shown in FIG. 4(2). Simultaneously with this, the priority signal A3 is supplied as the readout instruction signal of the voice signal to the recording section 17 through the OR circuit 20. Due to this, the voice information stored in the recording section 17 is read out and encoded by the code converting circuit 30. Thereafter, the information is supplied to the voice signal composition circuit 31 for conversion and composition. The voice signal outputted from the voice signal composition circuit 31 is supplied to the amplifier 26 through the I/O switching circuit 27 to be amplified there and is supplied to the speaker 25 to be generated as a voice sound. Thus, the recorded contents "visitor" of the recording section 17 is generated as shown in FIG. 4(2) so that it is possible to know that a visitor is expected at the alarm time of 10:30 A.M.

When the switch S4 is operated again, the signal "0" is outputted from the decoder 14 while the switch S4 is being operated. Thus, the time judging circuit 21 outputs the priority specifying signal corresponding to the next time information after 10:30 A.M. among the three pieces of alarm time information pieces (2:10 P.M., 5:00 P.M., and 10:30 A.M.), that is, the priority specifying signal A1 corresponding to the alarm time information (2:10 P.M.) of the first alarm time setting circuit 6. The priority specifying signal A1 is supplied to the display switching circuit 4 through the AND circuit 22 so that the alarm time information of the first alarm time setting circuit 6 is outputted from the display switching circuit 4. "PM 2:10" is displayed at the display device 5 as shown in FIG. 4(3). Simultaneously with this, the priority specifying signal A1 is supplied as the readout instruction signal for the voice signal to the recording section 15 through the OR circuit 18. Due to this, "meeting", which is the recorded contents in the recording section 15, is pronounced as shown in FIG. 4(3) so that it is possible to know that a "meeting" is planned at the alarm time of 2:10 P.M.

When the switch S4 is operated again, the signal "0" is outputted from the decoder 14. The time judging circuit 21 is then rendered operative and outputs the priority specifying signal corresponding to the last alarm time information, that is, the priority specifying signal A2 corresponding to the alarm time information (5:00 P.M.) of the second alarm time setting circuit 7. This priority signal A2 is supplied to the display switching circuit 4 through the AND circuit 23. Then, the display switching circuit 4 outputs the alarm time information of the second alarm time setting circuit 7 so that "PM 5:00" is displayed at the display device 5 as shown in FIG. 4(4). Simultaneously with this, the priority specifying signal A2 is supplied as the readout instruction signal of the voice signal to the recording section 16 through the OR circuit 19. Thus, "ring up", which is the recorded sound in the recording section 16, is outputted as shown in FIG. 4(4), so that it is possible to know that a phone call is planned at 5:00 P.M. When the switch S4 is operated again, the display returns to the normal display mode.

The alarm time is displayed every time the switch S4 is operated, and the recorded contents corresponding to the respective alarm times are generated so that the schedule of the day may be easily confirmed.

At the alarm times, a correspondence signal is outputted from the one of the first to third alarm time setting circuits 6 to 8 which has reached the alarm time, and this correspondence signal is supplied as the readout instruction signal to the corresponding recording section 15 to 17. The recorded contents of the recording sections 15 to 17 are generated as the sound notifying the alarm times. These alarm sounds will let one know the schedule to be performed at the alarm time.

In the above embodiment, the recorded contents were generated as sounds one by one according to the order of priority among a plurality of alarm times upon every operation of the switch S4. However, the operability may be improved if the respective recorded contents are continuously generated according to the order of priority upon a single operation of the switch S4.

What we claim is:

1. An electronic device having a timepiece function, comprising:

a source of reference frequency signals;

time counting means for counting said reference frequency signals to provide time data;

alarm time storing means including a plurality of alarm time memory sections for storing set alarm times;

voice data storing means including a plurality of voice data storing sections for storing messages corresponding to the respective set alarm times in any order;

voice producing means coupled to said voice data storing means for producing a sound, in the form of voice, corresponding to the message stored in said voice data storing means, when the time data provided by said time counting means reaches a set alarm time stored in said alarm time storing means;

a single external operation switch means which is operable to confirm the contents of the messages stored in said voice data storing means;

memory section designating means coupled to said single external operation switch means for producing a readout designating signal which designated a given order of said voice data storing sections of said voice data storing means for causing the messages respectively corresponding to the set alarm times to be read out in a time sequence of the count times of the timepiece when said single external operation switch means is operated; and voice producing control means coupled to said memory section designating means and responsive to said readout designating signal for reading out the messages in said given order from said voice data storing sections designated by said memory section designating means on the basis of said readout designating signal, and for causing a sound corresponding to the read out messages to be produced by said voice producing means.

2. The electronic device of claim 1, wherein said memory section designating means includes means for causing an individual voice data storing memory section of said voice data storing memory sections to be designated by each operation of said single external operation switch means.

3. The electronic device of claim 1, wherein said memory section designating means includes means for causing said voice data storing memory sections to be designated by a single operation of said single external operation switch means.

4. The electronic device of any one of claims 1, 2 or 3, wherein said single external operation switch means comprises a single manually operable switch.

5. The electronic device of any one of claims 1, 2 or 3, further comprising a further switch means coupled to said alarm time storing means for setting alarm times and causing said set alarm times to be stored in said alarm time storing means.

6. The electronic device of claim 5, wherein said single external operation switch means comprises a single manually operable switch.

7. The electronic device of claim 4, wherein said single external operation switch means comprises a record/confirm switch for selectively enabling storing of voice data in said voice data storing means and confirming the contents of messages stored in said voice data storing means.

* * * * *